United States Patent [19]

Lee

[11] Patent Number: 4,475,066

[45] Date of Patent: Oct. 2, 1984

[54] HIGH-COULOMB TRANSFER SWITCH

[75] Inventor: Ja H. Lee, Newport News, Va.

[73] Assignee: Information & Control Systems, Inc., Hampton, Va.

[21] Appl. No.: 430,405

[22] Filed: Sep. 30, 1982

[51] Int. Cl.[3] ..... H01J 7/24; H01J 11/04

[52] U.S. Cl. ..... 315/344; 313/148; 313/155; 315/111.01

[58] Field of Search ..... 315/344, 347; 313/148, 313/155, 156

[56] References Cited

U.S. PATENT DOCUMENTS

| | | | |
|---|---|---|---|
| 3,509,404 | 4/1970 | Rich | 313/155 |
| 3,509,405 | 4/1970 | Rich | 313/155 |
| 3,632,928 | 1/1972 | Emmerich | 313/148 |

*Primary Examiner*—Harold Dixon

[57] ABSTRACT

A high-coulomb transfer switch useful for high current pulse power supplies employs an inverse-pinch mechanism to sweep the arc current sheet over the electrodes. The inverse pinch currents are formed by a special electrode configuration wherein the inner electrode has the shape of a mushroom with the "cap" surrounding the "stem" so that the currents flowing in the electrode enclose the magnetic induction around the "stem". This results in repulsive forces on the outer currents in the "cap" causing the arc current sheet to rapidly move from the lip at the "cap" where the arc is initiated upward to the crown of the "cap" where occurs the final decay of the current. In the disclosed preferred embodiment, the inner, outer and return electrodes are generally cylindrical and placed coaxially. The switch can be operated under a vacuum or under a high pressure gas.

8 Claims, 3 Drawing Figures

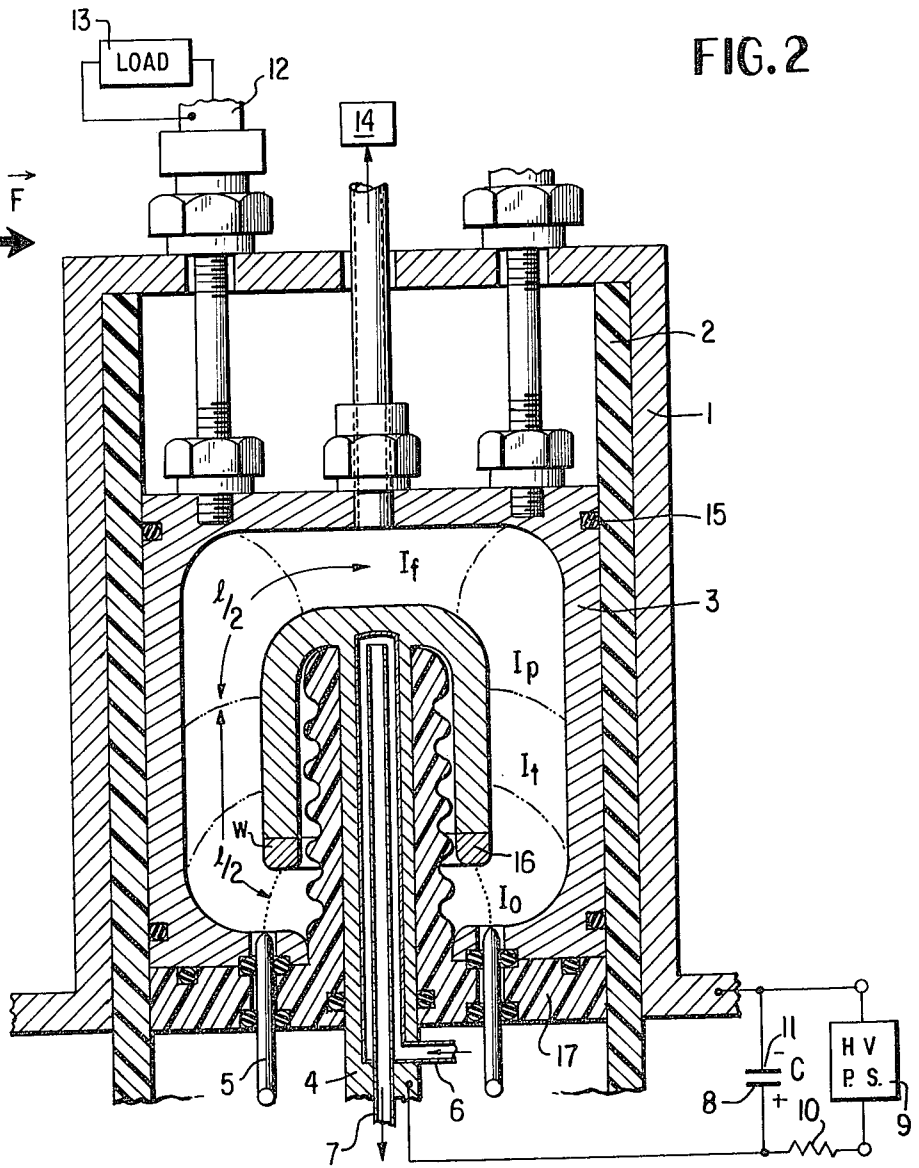
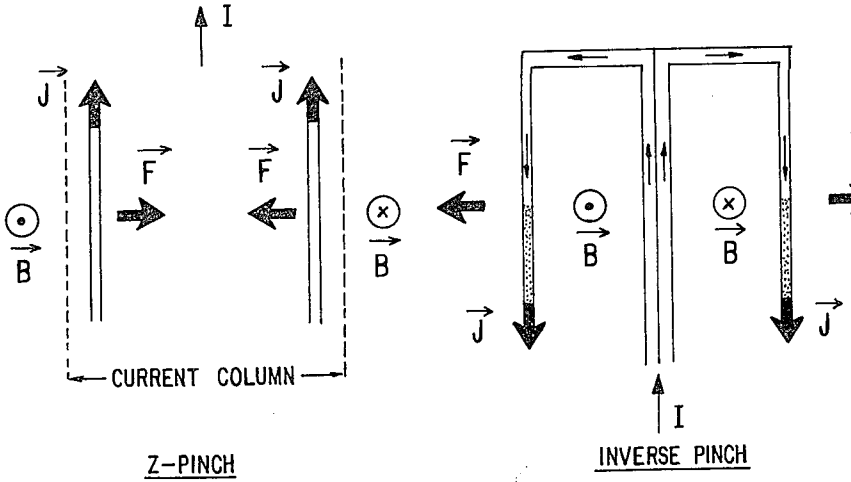
FIG. 1
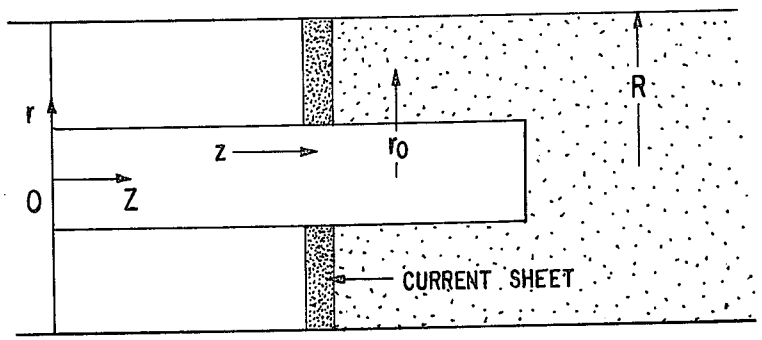
FIG. 3

HIGH-COULOMB TRANSFER SWITCH

BACKGROUND OF THE INVENTION

The present invention generally relates to electric arc discharge switches, and more particularly to a high-coulomb transfer switch useful for high current pulse power supplies. Such power supplies have particular application as power supplies for high power lasers used in welding and machining operations.

The most widely used high-coulomb transfer switches are trigatron spark gaps and thyratrons. Thyratrons, however, have lower limits on voltage hold-off and current capability; therefore, spark gaps are preferred for those applications that are beyond the limits of thyratrons. Even so, spark gaps can suffer severe damage due to hot-spot formations on the electrodes caused by the Z-pinch mechanism which constricts the current in an area of a few millimeters diameter. This phenomenon is discussed in an article by C. W. Kimblin entitled "Anode Phenomena in Vacuum and Atmospheric Pressure Arcs", published in *IEEE Transactions on Plasma Science,* PS-2 (1974), beginning at page 310. Briefly stated, the Z-pinch mechanism manifests itself from the ponderomotive force $\vec{F}=\vec{J}\times\vec{B}$, where $\vec{J}$ is the current density and $\vec{B}$ is the magnetic induction due to the current. Minor improvements of the spark gap geometry and the adoption of special materials have been ineffective in alleviating the effects of the Z-pinch mechanism.

One approach which has been taken to avoid hot-spot formations is disclosed in U.S. Pat. No. 3,471,733 issued to Joseph A. Rich. The device disclosed in this patent comprises a primary arc-electrode in the form of a re-entrant conductor so that arcing current flowing along the re-entrant path results in zero net magnetic field between the arc-electrodes. By effectively eliminating the magnetic field, arc currents do not bunch up and form hot-spots. Instead, the arc currents are diffuse and stationery between the electrodes. The current capacity of the basic device was increased in the improvement disclosed in U.S. Pat. No. 3,509,404 also issued to Joseph A. Rich. In the device disclosed in this patent, both the inner and outer electrode assemblies are re-entrant, and the outer electrode assembly incorporates a helical slotted current-carrying portion to cause arc rotation without exposure thereof to arcing current paths.

While the basic re-entrant geometry of the device disclosed in U.S. Pat. No. 3,471,733 does cause a substantial elimination of azimuthal magnetic field, it does not completely eliminate that magnetic field. The current carrying capacity was therefore limited by the interelectrode magnetic field present which causes current bunching or hot-spot formation. The rotating current produced by the device disclosed in U.S. Pat. No. 3,509,404 does help to alleviate this problem. However, both the basic device and the improved device are designed to be operated with a vacuum. High pressure operation is not possible due to current filament formation. Since a high pressure switch is usually inexpensive to construct, there are potentially a greater number of applications for high pressure switches than vacuum switches.

SUMMARY OF THE INVENTION

It is therefore an object of the present invention to provide a high-coulomb transfer switch having a larger useful like, higher current capability and faster switching than those of existing high-power switches.

It is another object of the invention to provide an electric arc discharge switch of practically unlimited current carrying capacity which may be operated either as a vacuum or high pressure device.

It is a further object of the invention to provide a novel high-coulomb transfer switch useful for high current pulse power supplies of high-power laser systems and other like applications.

The foregoing and other objects are achieved by employing an inverse-pinch mechanism to sweep the arc current sheet over the electrodes. The invention has a special electrode configuration to help form the inverse-pinch currents. Specifically, the inner electrode has the shape of a mushroom with the "cap" surrounding the "stem" so that the currents flowing in the electrode enclose the magnetic induction around the "stem" resulting in repulsive forces on the outer currents in the "cap". These repulsive forces cause the arc current sheet to rapidly move from the lip of the "cap" where the arc is initiated upward to the crown of the "cap" where occurs the final decay of the current. The fast moving current sheet during the entire discharge period eliminates hot-spot formation. Practically unlimited current carrying capacity is attained because the higher the current, the larger the moving force on the current sheet. This results in a larger area of the electrode being swept by the current sheet minimizing surface erosion. This same mechanism presents the formation of current filaments and therefore makes possible high pressure operation as well as vacuum operation.

BRIEF DESCRIPTION OF THE DRAWINGS

The specific nature of the invention, as well as other objects, aspects, uses and advantages thereof, will clearly appear from the following description and from the accompanying drawings, in which:

FIG. 1 is a schematic diagram illustrating the difference between the Z-pinch and inverse pinch mechanisms;

FIG. 2 is a cross-sectional view of the preferred embodiment of the high-coulomb transfer switch according to the invention; and FIG. 3 is a schematic diagram of a mathematical model used to describe the operation of the invention.

DESCRIPTION OF THE PREFERRED EMBODIMENT

Referring now to the drawings, and more particularly to FIG. 1, the inverse pinch mechanism used by the invention at the right side of the figure is contrasted with the Z-pinch mechanism at the left side of the figure. The ponderomotive force $\vec{F}$ due to the Z-pinch mechanism constricts the current. Note that the magnetic induction surrounds the current. In contrast, in the inverse pinch mechanism, the currents form the shape of a mushroom enclosing the magnetic induction around the "stem" resulting in repulsive forces on the outer currents.

The special electrode configuration which helps to form the inverse-pinch currents is shown in FIG. 2. The brass return electrode 1 is electrically connected to the one polarity (−) of a capacitor bank 11 or power supply 9 and carries the return current from the load 13 through coaxial cable 12. The other polarity (+) of the capacitor bank 11 is electrically connected to the brass inner electrode 4 which has a tungsten ring 16. The trigger pin 5 are located densely on a circle opposite to the tungsten ring and are used to initiate the switch by a high voltage pulse. The breakdown current $I_o$ (dotted line) flows through between electrodes 3 and 4. Subsequently, the current is rapidly moved away as shown by $I_t$, $I_p$, $I_f$ in FIG. 2, where $I_t$ is current at a few microseconds later, $I_p$ is the peak current and $I_f$ is the current at the final decay. These currents are carried to the load 13 through the inner conductor of the coaxial cable 12. For continuous operation, the inner electrode 4 is cooled by suitable cooling fluid running through the inlet 6 and the outlet 7. The switch is vacuum sealed by several O-rings 15. The insulation 17 is made of machinable glassceramic Macor, and the plexiglass cylinder 2 electrically separates the return electrode 1 and the outer electrode 3. The resistor 10 is used to limit the charging current from the power supply. The vacuum pump 14 maintains a suitable vacuum in the switch for high voltage hold-off. Note that the inner, outer and return electrodes are generally cylindrical and placed coaxially. The switching of the current takes place in the vacuum chamber formed by these inner and outer electrodes.

To illustrate the operation of the switch, the high voltage power supply 9 is turned on to charge the capacitor bank 11. The load 13 is isolated by the switch which is under a high vacuum less than $10^{-2}$ Torr. The annular gap between the inner electrode and the base of the outer electrode is adjusted according to the Paschen curves for gas breakdown voltages. For an example, over 11 mm is required to hold off 100 kVDC in the $10^{-2}$ Torr air gap. The selection of the type of gas (various types of electronegative gases, e.g. $SF_6$ may be used) and the gas pressure may be made in addition to varying the inter-electrode gap to hold-off the high voltage used. When the capacitor bank 11 is fully charged, a sharp trigger pulse is introduced through the trigger pins 5 which are symmetrically placed in the base of the outer electrode. The trigger pulse (its generator is not shown) must have a fast rise time $<100$ ns and the polarity opposite to the charging voltage so that the fast-breakdown mode of the gap can be utilized. Due to the annular geometry of the gap, the initial breakdown current $I_o$ now forms the "mushroom" of the current sheet with the currents flowing through the inner electrode. In short, the inverse-pinch geometry is thus formed. Therefore, the current sheet is subjected to the ponderomotive force and radially expelled from the axis. The action minimizes the exposure time of the insulator surface to the hot plasma radiation and the accompanying shock waves. The exposure time in the invention is estimated to be $<10\%$ of the discharge period while, in the conventional switches, the insulators are exposed to the discharge for its entire period. As the inverse pinch force increases proportionally to $I^2$, the positions of the current sheet are moved as shown by the dotted lines $I_t$, $I_p$ and $I_f$ in FIG. 2.

The speed of the current sheet may be calculated by using the snow plow model described by J. Maxan and J. Eddleman in their article entitled "Two-dimentional Magnetohydrodynamic Calculations for the Plasma Focus" published in *Physics of Fluids*, 21 (1978), beginning at page 1856. To describe the principle of the snow plow model we consider a simple one-dimensional analysis with two cylindrical electrodes located coaxially as shown in FIG. 3. Consider the current sheet in the switch at z. $r_o$ is the radius to the midpoint of the current sheet. A cylindrical symmetry is assumed. Then the equation of motion can be written as follows:

$$\frac{d}{dt}\left(2\pi t_o \rho_{oz} \frac{dz}{dt}\right) = 2\pi r_o \frac{\mu o}{2}\left(\frac{I}{2\pi r_o}\right)^2.$$

The life side of the equation is the rate of the momentum change of the gas that has accumulated from the base of the switch, and the right side equals to $\vec{F}=\vec{I}\times\vec{B}$ or the ponderomotive force of the magnetic induction due to the current I. By solving this eqaution with the initial conditions and the current wave form, the current sheet velocity dz/dt, and consequently z, the position of the current sheet as functions of time are obtained. By using this model, the length of the switch and the gas pressure in the chamber are adjusted prior to having the peak current $I_p$ midway of the active length in the switch chamber, so that the diminishing current sheet reaches the top of the inner electrode. This is in contrast to the Maxon and Eddleman model in which the peak current is placed near the device axis to obtain maximum compression (z-pinch) for dense plasma production. Some corrections to the results of the snow plow model are the formative time lag for breakdown, which could be reduced to below 10 ns by using a high overvoltage, and three dimensional effects due to the deviation form the two dimensional symmetry of the current sheet in the actual switch. Those corrections are small and readily made from the experimental data. The electrical parameters such as the inductance, resistance, and capacitance of the switch can be calculated easily since the switch has a cylindrical symmetry.

Geometrical modifications to the preferred embodiment of the invention are possible by using parallel-plate electrodes in lieu of cylindrical electrodes yet maintaining the inverse-pinch process. Other methods of triggering the switch are gas injection and laser beam injection in lieu of high voltage pulse triggering.

The following advantages over the conventional trigatron switches are recognizable from the description of the invention given above. (a) Reduced wear of the electrode material: This is due to the fact that the strong pinching of the current sheet is eliminated from the new switch since the inverse-pinch mechanism is utilized for moving the "feet" of the current over a large area. (b) Reduced wear of the insulator material: For the same reason above, fast detachment of the current sheet from the insulator which shortens the exposure time, results in reduced shock and radiation damages to the insulator. In a conventional trigatron switch, the insulator is affected for the full discharge period. (c) Longer useful life: The advantages of (a) and (b) translate into a longer useful life for the new switch compared with conventional switches. (d) Higher current capability: The advantages of (a) and (b) also result in a higher current capability for the new switch in comparison with the conventional spark gaps. High power lasers applicable for welding and machining require switching of over 100KA peak current at a repetition rate higher than 10 Hz. Due to the reduced current density and rapid motion of the "feet" of the current on the electrode surface, a significant increase of the current capability is provided by the invention. (e) Reduced switch inductance: The inductance L of a unit length of a coaxial current pair is expressed as $L=(\mu/2)ln(r_o/r_i)$ where $\mu$ is permeability, $r_o$ radius to the outer current, and $r_i$ radius of the inner current. For the conventional trigatron, the ratio $r_o/r_i$ becomes very large due to the reduction of $r_i$ by z-pinch mechanism. For example, $r_o=10$ cm and $r_i=0.1$ cm or $r_o/r_i=100$ are typical for the conventional trigatron while $r_o/r_i \leqq 2$ is estimated for the new switch. A reduction of the inductance by a factor of $\geqq 7$ can be seen in this example. Since the risetime of an electric circuit is approximately equal to its quarter period $$t_{\frac{1}{4}} = \frac{\pi}{2} \sqrt{LC},$$

reduction of the component inductance is highly desirable in the fast pulsed power systems designed for laser excitation or generation of energetic particle beams.

I claim:

1. A high-coulomb transfer switch comprising: an inner electrode having the shape of a mushroom with the cap surrounding the stem so that currents flowing in the electrode enclose the magnetic induction around the stem resulting in repulsive forces on the outer currents on the cap in an inverse pinch mechanism;

an outer electrode coaxial with and surrounding the inner electrode, the outer electrode being electrically insulated from but mechanically sealed to the inner electrode to define an arc discharge volume therebetween;

means for causing an electric arc discharge to be established between the lip of the cap of the inner electrode and the outer electrode, the repulsive forces due to the inverse pinch mechanism causing the arc current sheet to rapidly move from the lip of the cap upward to the crown of the cap where occurs the final decay of the current; and means for connecting the inner and outer electrodes in circuit with a load.

2. A high-coulomb transfer switch as recited in claim 1 wherein said means for connecting comprises a return electrode coaxial with the inner and outer electrodes, the return electrode surrounding the outer electrode but electrically insulated therefrom, the load being electrically connected across the outer and return electrodes.

3. A high-coulomb transfer switch as recited in claim 2 further comprising a capacitor bank electrically connected across the return electrode and the stem of the inner electrode.

4. A high-coulomb transfer switch as recited in claim 1 wherein said means for causing an electric are discharge comprises a plurality of trigger pins symmetrically located in the base of the outer electrode opposite the lip of the cap of the inner electrode.

5. A high-coulomb transfer switch as recited in claim 4 wherein the lip of the cap of the inner electrode is provided with a tungsten edge.

6. A high-coulomb transfer switch as recited in claim 2 wherein the inner, outer and return electrodes are generally cylindrical.

7. A high-coulomb transfer switch as recited in claim 1 wherein the arc discharge volume is a vacuum.

8. A high-coulomb transfer switch as recited in claim 1 wherein the arc discharge volume is filled with a gas under pressure.

* * * * *